US006010372A

United States Patent [19]

Ward

[11] Patent Number: 6,010,372

[45] Date of Patent: Jan. 4, 2000

[54] CROSS-TALK REDUCTION MOUNTING BLOCK FOR CONNECTORS

[75] Inventor: Donald A. Ward, Danube, Minn.

[73] Assignee: Communications Systems, Inc., Hector, Minn.

[21] Appl. No.: 08/928,349

[22] Filed: Sep. 12, 1997

[51] Int. Cl.[7] ..... H01R 9/22

[52] U.S. Cl. ..... 439/712

[58] Field of Search ..... 439/712, 571, 439/395, 402, 404, 715

[56] References Cited

U.S. PATENT DOCUMENTS

| | | | |
|---|---|---|---|
| 5,127,845 | 7/1992 | Ayer et al. | 439/395 |
| 5,156,554 | 10/1992 | Rudoy et al. | 439/108 |
| 5,324,211 | 6/1994 | Siemon et al. | 439/404 |
| 5,575,680 | 11/1996 | Suffi | 439/404 |

FOREIGN PATENT DOCUMENTS 0 766 352 A2 4/1996 European Pat. Off. .

*Primary Examiner*—Lincoln Donovan
*Assistant Examiner*—Eugene G. Byrd
*Attorney, Agent, or Firm*—Westman, Champlin & Kelly, P.A.

[57] ABSTRACT

A mounting block has a plurality of insulation displacement connectors or terminal clips, mounted in openings in the block in traverse rows which are evenly spaced along the length of the block. The block is a dielectric body of conventional shape having fanning strip sections at its opposite margins. The insulation displacement connectors or terminal clips are loosely received through holes in the block and have a pair of wire-receiving prongs that are symmetric about a central axis so that the terminal clips do not require a specific orientation relative to the center line of the block. The terminal clips each have a wire-retaining receptacle near the upper end and are slit so that a wire may be slid down and the wire insulation displaced for electrical connection to the terminal clip. The slit forms resilient arms that are tapered from an upper end downwardly. Cross-talk between terminal clips that are adjacent in longitudinal direction is controlled by altering the amount of plastic material spacing adjacent pairs of terminal clips in longitudinal direction such that, in regions where the plastic material is reduced, an air gap between such terminal clips to reduce the dielectric constant between that pair of terminal clips.

10 Claims, 4 Drawing Sheets

CROSS-TALK REDUCTION MOUNTING BLOCK FOR CONNECTORS

BACKGROUND OF THE INVENTION

The present invention relates to a terminal block assembly of the type used for terminating telephone and data transmission lines on distribution frames, and is constructed to control the dielectric constant between selected pairs of terminals for reduction of unwanted cross-talk. Symmetrical insulation displacement terminals are also disclosed.

A terminal block assembly of standard configuration is shown in U.S. Pat. No. 5,127,845. The terminal block has a body having a series of evenly-spaced holes that are arranged such that four holes are aligned in lateral rows. The holes are arranged in aligning columns of evenly spaced holes extending in direction of the longitudinal length of the terminal block. The outer edges of the terminal block have fanning strips, one aligned with each of the rows of openings, and terminal clips are inserted into the openings and held in place with a suitable retainer. The terminal clips project through the openings and are capable of receiving wires, such as communication wires. The terminal clips disclosed are not symmetrical and have to be oriented so that a pair of terminals on one side of the block has to be reversed 180° from the pair of terminals in the same row on the opposite side of the block.

Another prior art device of the general type is shown in U.S. Pat. No. 5,324,211, wherein the same shape terminal clip is used in a terminal block that has columns of holes which are spaced at uneven intervals in order to reduce cross-talk between selected ones of the terminal clips. The hole separation is such that the space between tip-and-ring conductors of a pair of wires is reduced relative to the separation between the terminal clips holding wires from two different pairs of wires.

In both of the above-mentioned patents and in the other prior art, the terminal clips are formed in side by side pairs and are not symmetrical about a center line, so they have to be oriented appropriately for assembly into the terminal block. This increases manufacturing time and requires specialized fixtures.

SUMMARY OF THE INVENTION

The present invention relates to a terminal block utilizing symmetrical "66"-type terminal clips for connecting communication wires in a terminal block assembly that holds a plurality of pairs of insulated wires and is constructed to reduce unwanted cross-talk between terminals. The terminal clips shown in use are insulation displacement-type terminals that have resilient arms having a central slot between them through which a wire is slid or displaced until the insulation is moved and electrical contact is made between the arms and the wire. The terminal clips are formed to provide a high degree of spring load on the wires so that the wires are securely held and so that a good electrical connection is obtained.

The terminal block is a molded piece of plastic that has a series of lateral rows of openings (4 across) and four columns of a large number of openings along the longitudinal length of the block. The rows are transverse, and the columns are essentially longitudinally-extending rows with all the holes in alignment. The opposite edges of the terminal block have fanning strips aligned with the rows of openings, and these are used for separating and securing twisted pairs of wires that are attached to the respective terminal clips. The spacing between adjacent pairs of openings in the longitudinal direction is maintained equal. The dielectric constant between terminals that are in adjacent rows but which are connected to wires of a different twisted pairs of wires is made to be substantially higher than the dielectric constant between terminal pairs that are spaced in longitudinal direction and which are connected to the separate wires of a single twisted pair, for example, the tip-and-ring conductors of a pair of twisted wires. The alternation or changing of the dielectric constant is accomplished by reducing the amount of plastic in the gap spacing the terminal clips which will be connected to wires of different pairs to reduce the dielectric constant between such pairs of wires and, thus, reduce cross-talk between separate twisted pairs of wires.

The reduction in plastic material to increase the effective air gap is easily accomplished in a mold. The mold divider plastic material that is formed between terminal clips that are connected to wires of the same pair will provide adequate structural strength and adequate electrical separation.

In this manner, a highly-efficient terminal block is utilized to achieve the desired result of reducing cross-talk between terminals that are in adjacent transverse rows and which are connected to wires of separate or different twisted pairs.

DETAILED DESCRIPTION OF THE PREFERRED EMBODIMENTS

Figure 1:
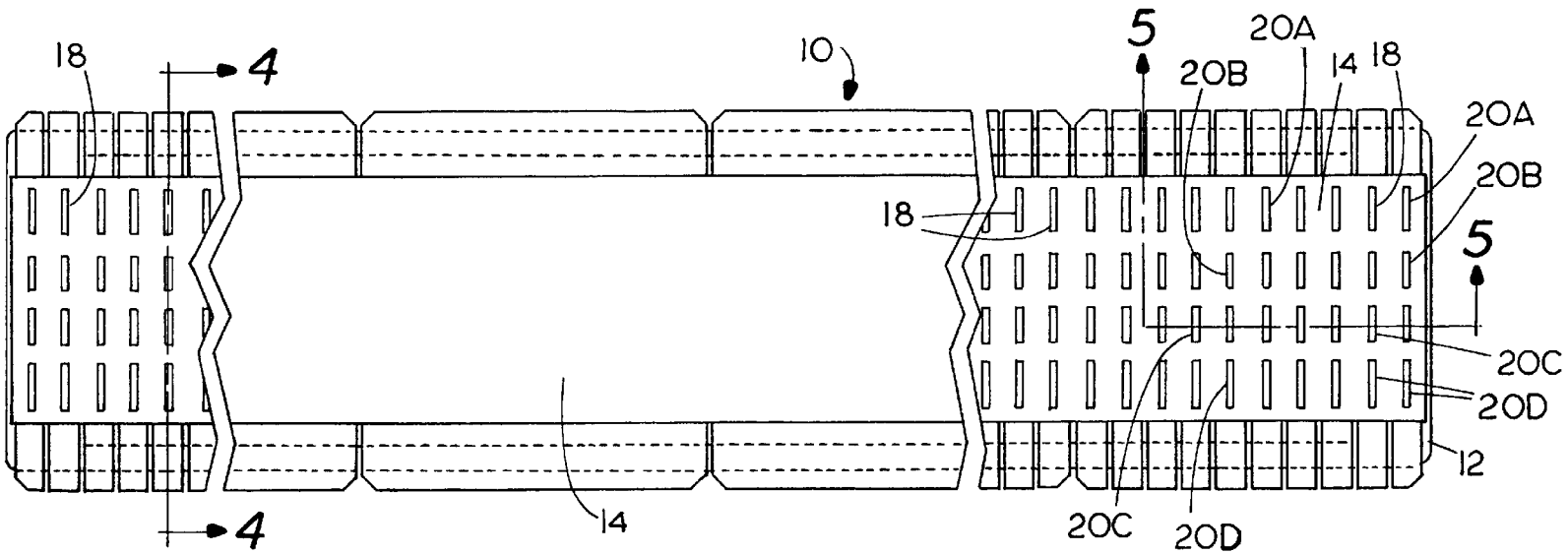
FIG. 1 is a top view of a portion of a terminal block made according to the present invention.
Figure 2:
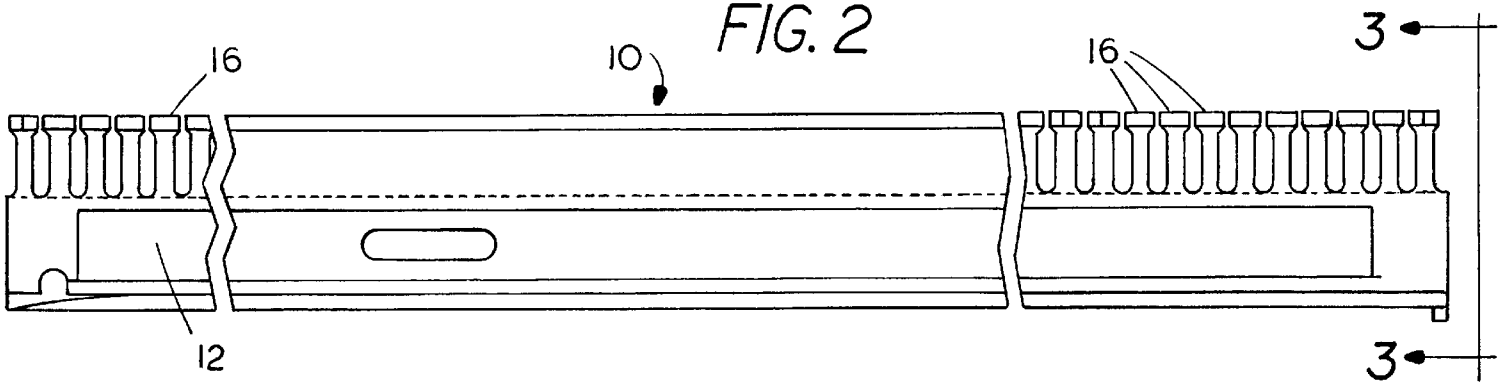
FIG. 2 is a side elevational view of the terminal block shown in FIG. 1.
Figure 3:
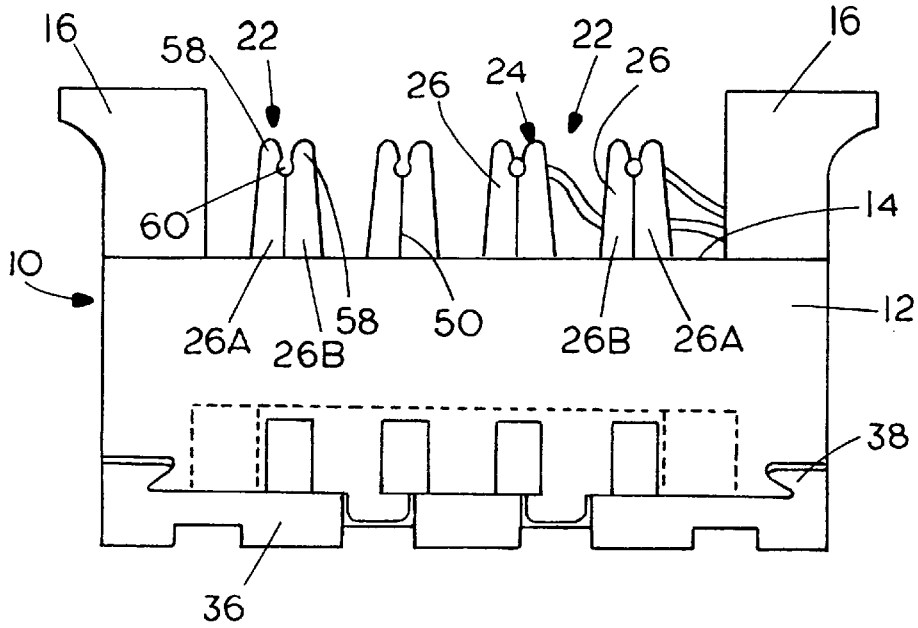
FIG. 3 is an end view of the terminal block with a retainer plate in place and taken generally on line 3—3 in FIG. 2, shown with terminal clips in place.

In FIG. 1, a terminal block 10 of essentially standard outer configuration is shown in plan view showing a number of the evenly spaced openings in which terminal clips for communication lines or wires will be mounted. Terminal block 10 comprises a dielectric body 12 and has a central bed 14, and on the opposite edges thereof, there are a plurality of fanning strips 16. The fanning strips 16 are upright posts that are aligned on opposite sides of the bed and which are centered on a plurality of transverse rows 18 of rectangular holes.

The rows 18 each include individual holes 20A, 20B, 20C, and 20D. The holes are also arranged in longitudinal rows or columns, that extend with the center axes extending generally parallel to the side edges of the bed 14. The holes 20A–20D are rectangular and it can be seen that the holes 20A and 20D are slightly longer than the holes 20B and 20C for purposes of receiving the terminal clips that will be described.

Terminal block 10 has a desired standard length, and it is shown broken for the purpose of illustration. The fanning strips 16, as can be seen, have spaces between them to permit twisted wire pairs to pass through, and then to each terminal clip positioned in the openings, or holes, 20A–20D.

Figure 4:
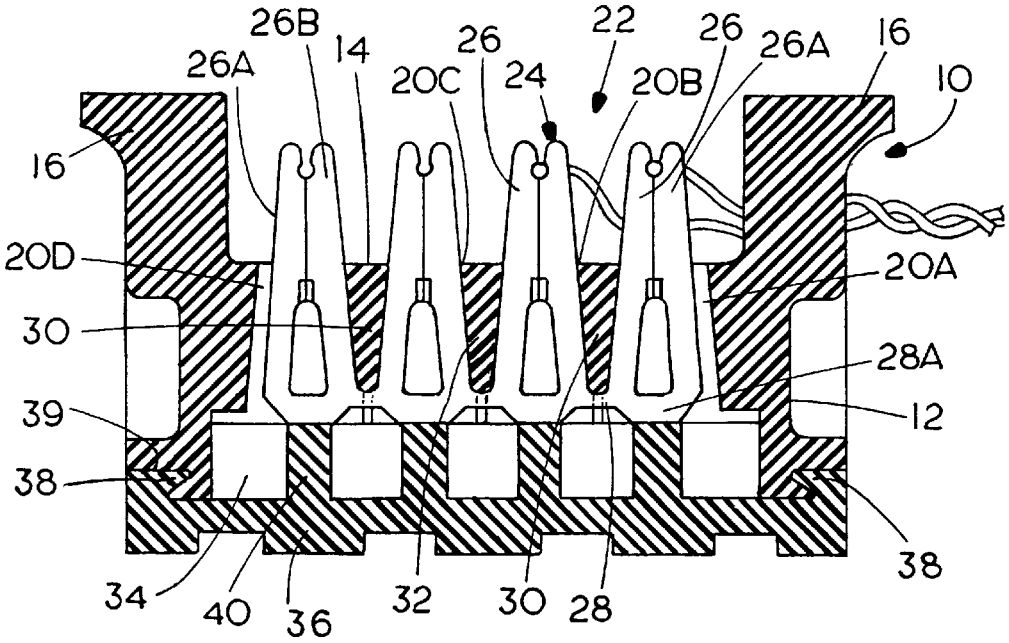
FIG. 4 is a sectional view taken along line 4—4 in FIG. 1, with terminal clips in place.

Referring to FIG. 4, which is a sectional view, it can be seen that a plurality of terminal clips, shown generally at 22, are mounted in the holes. The clips 22 are formed into separate clip assemblies 24, each of which has a pair of wire receiving prongs 26 that are mounted onto a common cross base 28. The wire receiving prongs 26, as shown, are spaced apart and form a receptacle therebetween. The receptacle is slid up over a locator divider 30 (see also FIGS. 5 and 6). A separate locator divider is molded in place in the block between the individual openings 20A and 20B, and 20C and 20D. The dividers 30 serve to locate the pair of prongs in the proper location for extending through the respective openings. A center divider 32 is also provided to separate the two pairs of terminal clips 22 in each row 18.

The terminal block 10 has a recess 34 on the bottom of base side thereof, and the terminal clips 24 are slipped from the recess side as pairs into the respective openings with the recess 34 on top. When the terminal clips are all in place for all of the openings of the block 10, a cover plate 36 (FIG. 4) is slid into place. The cover plate has flanges 38, which fit into grooves 39 formed in the side walls of the terminal block. The plate 36 has a plurality of ribs 40 that are positioned to align with projections 28A of the base 28 of each pair of terminal clips that project slightly away from the center portions of the base 28 and are supported on the ribs 40 so that the terminal clips 22 are held in place in the openings. The retainer plate, or cover plate, 36 can be retained in place with suitable catches, as is known.

The ribs 40 can be positioned to hold individual prongs 26, if the prongs are separated and are not joined by a base 28. The prongs 26 are wire-receiving prongs and are held securely in place so that they can act as insulation displacement connectors when an insulated wire is slid into the clips.

The recess 34 extends for the full length of the terminal block 10 so that each rib 40 will hold all of the terminal clips in one column in place.

The openings, or holes, 20A–20D in one row 18 are separated from the openings, or holes, 20A–20B in a second row or adjacent rows by cross-members formed in the bed that extend between the rows. In the present invention, the cross-members are selected in depth or height, in order to provide for a difference in the effective dielectric constant between the terminal clips in alternating adjacent rows.

Figure 5:
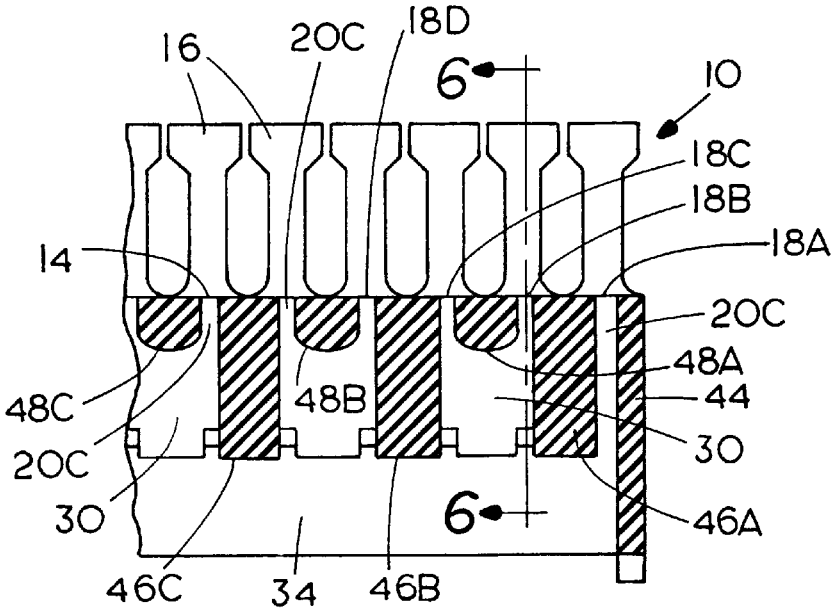
FIG. 5 is an enlarged sectional view taken along line 5—5 in FIG. 1.
Figure 6:
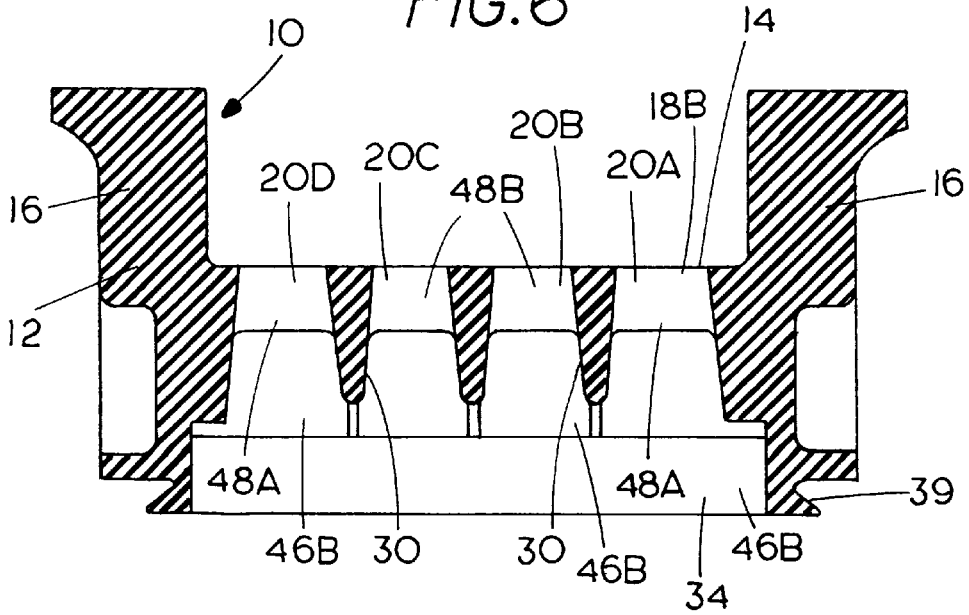
FIG. 6 is a sectional view taken along line 6—6 in FIG. 5.

Referring to FIG. 5, it can be seen that holes, or openings, 20C from each of the individual rows 18 are shown in cross-section at one end of the terminal block. The terminal block end wall 44 is adjacent a first row 18A of the holes 20A, 20B, 20C and 20D. The second row, shown at 18B, has the openings 20A–20D separated from each other by a dielectric plastic material rib, shown at 46A; and the third row 18C of openings 20A–20D is separated from row 18B by cross-ribs 48A. The cross-ribs extend laterally between the longitudinally wall dividers as shown in FIG. 6. The next row 18D of openings 20A–20D is separated by a full depth divider ribs 46B that extend, again, between the longitudinal extending dividers 30 and 32, as well over to the side walls of the block. Then, the fourth row 18D is separated from the fifth row 18E of openings 20A–20D by a shallow rib 48B. The shallow ribs have less mass than the full depth divider ribs.

Since plastic has a much higher dielectric constant than air (approximately three times that of air), it can be seen that the dielectric constant between the clips that occupy the first row 18A and the second row 18B is higher than the dielectric constant for the gap with the short divider wall 48A between the second row 18B and the third row 18C. This is repeated for the alternating rows throughout the longitudinal length of the block 10. The terminal clips that are positioned in the rows 18A and 18B, and holes 20A will be connected to a single pair of twisted wires; and the clips that are in the openings in the third and fourth rows 18C and 18B along one of the columns, such as the columns formed by openings 20A, will be connected to the individual wires of a second twisted wire pair.

This means that the wires of different pairs are separated by an air gap formed by the shortened divider rib 48A that has a lower dielectric constant to reduce cross-talk between the pairs of twisted wires at the terminal clips. Also, the reduced dielectric constant between the terminal clips that carries the conductors from a single pair offers the benefit of helping preserve the balance and coherence of the signals on the twisted pair.

By increasing the air gap between the terminal clips for different twisted pairs and keeping the terminal clips for the wires from a single pair separated by a dielectric material that has a much higher dielectric constant than air, the desired results of reducing cross-talk between separate twisted pairs, but preserving the balance and coherence of the signals in wires from a single twisted pair, is achieved. It should be noted that the rows 18 are evenly spaced along the length of the bed 14 throughout the entire length of the terminal block 10 to maintain compatibility with previous units.

Figure 7:
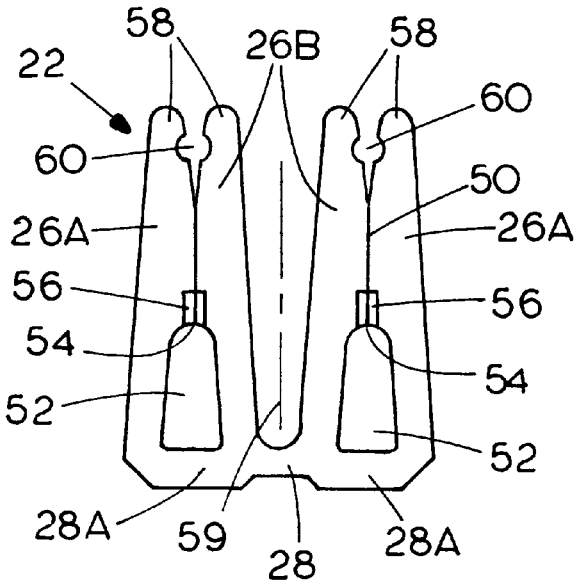
FIG. 7 is an enlarged view of an insulation displacement terminal clip made according to the present invention.
Figure 8:
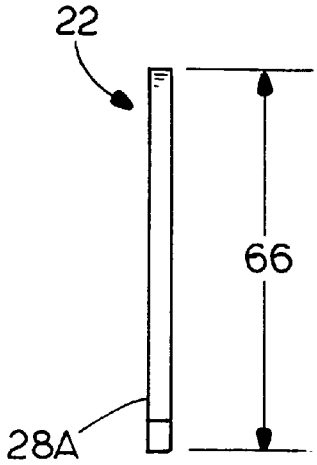
FIG. 8 is a side elevational view of a terminal clip of FIG. 7.
Figure 9:
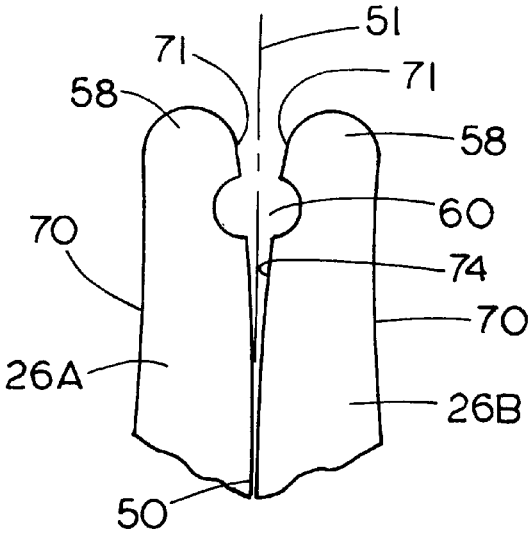
FIG. 9 is an enlarged view of an upper end portion of a terminal clip shown in FIG. 7.

The terminal clips 22 shown are specifically adapted for quick assembly in the terminal block 10 and are shown in detail in FIGS. 7, 8, and 9. It is to be understood that standard terminal clips will work as well. The terminal clips 22 are made of a suitable material that can be stamped from a base sheet and is a good electrical conductor. The preferred form of each of the prongs 26 includes two arms 26A and 26B that are separated by a wire-receiving slit 50 in the upper or outer arm sections. The arms 26A and 26B are joined by the base portion 28A and arms 26A and 26B of one prong 26 are joined to the other prong 26 by the junction base portion 28. The prong 26*s* are separated by a recess 53 shaped to fit over the divider walls 30, 30 in each row 18 of openings in the terminal block 10.

A generally oval shape aperture 52 is formed near the base portion between each set of prongs 26A and 26B and, as shown, the aperture 52 tapers to narrow slightly in an upward direction from the base 28A to upper end 54, where the slit 50 joins the oval aperture. Prongs 26 are coined in the region shown at 56 to provide for a slight separation of the slit 50, particularly at the upper end portions of the arms 26A and 26B of each pair.

The arms 26A and 26B taper toward the axis 51 of the slit 50 from the base upwardly and have rounded upper ends indicated at 58, which are spaced apart and form a wire-receiving receptacle 60. Ends 58 of the arms 26A and 26B are identical, so the prongs 26 are symmetrical about the axis of the slit 50 and the terminal clip 22 also is symmetrical about the center axis 59 of the recess 53 which divides the prongs 26 of each terminal clip 22. The recess 53 permits the terminal clip to slide onto the dividers 30, defining the openings 20A and 20B, and 20C and 20D, respectively.

The symmetrical terminal clips 22, can therefore be oriented without regard to right or left hand, and can be rotated 180° about axis 59 and will be operable in the same two openings of the terminal. In other words, the clips are symmetrical about their central axis 59, as well as each pair of arms 26A and 26B being symmetrical about the axis 51 of the slit 50.

One of the benefits of having the terminal clips 22 formed as shown, without an overhanging tab which overlies the wire-receiving opening 60, is that the overall height of the terminal clip is reduced substantially. The overall height is from the very bottom edge of the base portion 28A up to the top of the rounded tip 58, as shown by the dimension 66.

The arms 28A and 28B taper from the base portion 28A to the rounded ends 58 in order to have some resilience. The central opening 52 is selected to provide the desired amount of spring force on a wire slid into the slit 50. The side edges of the arms are tapered about 45° inwardly along the major portion of their height. The outer side edges of the arms become parallel to the plane passing through the slit 50 and perpendicular to the plane of the clips at a lever shown at 70 slightly below the wire receptacle 60. (See FIG. 9). The overall height 66 in the preferred embodiment of the terminal clips is about 0.706 inches. The edges of the slit 50 taper slightly outwardly to provide a gap for plating from just above the coined region 56 up to the wire receptacle 60.

The side edges around the wire receptacle 60 are rounded in the main portion of receptacle and then taper outwardly in regions 71 to join the rounded ends 58. The base 28 of the terminal clips is made to fit into standard terminal blocks. As shown in FIG. 9, the taper of the edge region 71 above the wire-receiving receptacle 60 is approximately 8.5° from the center plane passing through axis 51. There is a trim taper shown at 74, just below the wire-receiving receptacle 60, to permit lead-in of a wire being pressed down into the slit 50. These terminals clips are of the insulation displacement type, which will slice into the insulation and down to the bare wire as a wire is slid along the slit 50 through the tapered area 74.

The ease of assembly of the symmetrical clips 22 reduces manufacturing time, and the construction of the terminal block with the alternating effective dielectric constant between the rows of openings in each column gives the benefit of a relatively high dielectric constant between wires (tip and ring wires) from the same twisted pair and a low dielectric constant between the terminal clips that carry wires of a different pair. Because of their smaller size, the terminal clips of the present invention reduce the amount of radiant area so there is not as much surface on the terminal clips for generating fields causing cross-talk.

The control of the dielectric constant between adjacent electrical conductors, or terminal clips is useful on many different types of terminal clip supports, including single columns of adjacent openings for conductors or clips, or where the cross rows have only two openings instead of four. The single column strips are used presently.

Although the present invention has been described with reference to preferred embodiments, workers skilled in the art will recognize that changes may be made in form and detail without departing from the spirit and scope of the invention.

What is claimed is:

1. A terminal block assembly for mounting a plurality of terminal clips, each designed to receive a wire comprising:

a mounting block having a bed and fanning strip members at opposite side edges of the bed spaced along a longitudinal direction of the bed, the bed having a plurality of openings arranged in lateral rows extending in direction between the side edges of the bed and in longitudinal columns extending in the longitudinal direction of the bed, said rows of openings being evenly-spaced in the longitudinal direction in the columns, and the openings in the columns being separated by ribs that extend transversely, the ribs between alternate rows of openings being of a different mass of the dielectric material to control the effective dielectric constants between adjacent pairs of the terminal clips in the column; and each terminal clip in the openings including a flat body and a wire-receiving prong having a slit therethrough defining a pair of arms, to permit insertion of a wire and to displace insulation as the wire is inserted.

2. The terminal block assembly of claim 1, wherein the ribs are selected to reduce the effective dielectric constant between pairs of ribs carrying tip-and-ring conductors of a twisted pair of wires attached to the terminal clips.

3. The terminal block assembly of claim 1, wherein the rows of openings are spaced in longitudinal direction substantially 0.40 inches apart.

4. The terminal block assembly of claim 1, wherein the ribs between a first pair of rows of terminals have a depth that extends from a base of the terminal to a bed surface, and the rib between the next row of terminals in a column including one of the rows of terminals of the first pair having a depth of less than one-half the depth of the first ribs.

5. The terminal block assembly of claim 1, wherein the block is a molded block.

6. A block mounting a plurality of conductors in at least one row comprising:

a bed of a dielectric material having a plurality of openings arranged in at least one column extending in a longitudinal direction of the bed, said openings being evenly-spaced in longitudinal direction and being separated by ribs that extend transversely to the longitudinal, the ribs between alternate openings in the at least one column being of a different mass of the dielectric material to control the effective dielectric constants between adjacent pairs of openings in the column such that cross-talk between conductors in the openings is controlled.

7. The terminal block assembly of claim 1, wherein the ribs are selected to reduce the effective dielectric constant between pairs of openings carrying tip-and ring conductors of a twisted pair of communication wires.

8. The terminal block assembly of claim 1, wherein said terminal clip comprises a pair of wire receiving prongs that extend from a base, the base of the terminal clips being positioned such that the ribs having the greater mass extend along a substantial length of the terminal clips, and the ribs having a lesser mass extending for a less distance along the terminal clips in adjacent openings.

9. The terminal block assembly of claim 1, wherein the said mounting block is made of a molded plastic material having a dielectric constant substantially one-third of that of air.

10. The terminal block assembly of claim 1, wherein said terminal clips in a pair of adjacent openings separated by ribs of lesser mass have portions of surfaces of the terminal clips facing the adjacent terminal clips separated by an air gap, and an opposite surface of the same terminal clips having a greater portion of the opposite surface facing a rib of greater mass.

* * * * *